US007661342B2

(12) United States Patent
Liu

(10) Patent No.: US 7,661,342 B2
(45) Date of Patent: Feb. 16, 2010

(54) METALLIC WORKPIECE HAVING PUNCHED HOLES AND METHOD FOR MAKING THE SAME

(75) Inventor: Zhi-Da Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 221 days.

(21) Appl. No.: 11/852,340

(22) Filed: Sep. 10, 2007

(65) Prior Publication Data

US 2008/0236350 A1 Oct. 2, 2008

(30) Foreign Application Priority Data

Mar. 28, 2007 (CN) ..... 2007 1 0200341

(51) Int. Cl.
*B26D 5/00* (2006.01)

(52) U.S. Cl. ..... 83/35; 83/36; 83/365

(58) Field of Classification Search ..... 83/35, 83/36, 365, 367, 74, 522.13, 522.26, 684, 83/686, 219, 220; 72/333, 334, 327; 428/597, 428/596, 131, 132

See application file for complete search history.

(56) References Cited

U.S. PATENT DOCUMENTS

| | | | | |
|---|---|---|---|---|
| 3,530,748 | A * | 9/1970 | Fuller | 83/50 |
| 5,027,683 | A * | 7/1991 | Kakimoto | 83/76.6 |
| 5,227,641 | A * | 7/1993 | Cheng | 250/559.23 |
| 5,249,492 | A * | 10/1993 | Brown et al. | 83/23 |
| 5,555,760 | A * | 9/1996 | Kadis | 72/334 |
| 6,874,395 | B2 * | 4/2005 | Ishii et al. | 83/364 |

FOREIGN PATENT DOCUMENTS

JP 4-28428 * 1/1992

* cited by examiner

*Primary Examiner*—Stephen Choi
(74) *Attorney, Agent, or Firm*—Frank R. Niranjan

(57) ABSTRACT

An exemplary method for making a metallic workpiece includes: (a) providing a metallic sheet and a punching machine, wherein the metallic sheet comprises a curved portion and a plurality of predetermined punching areas; the punching machine comprises a die set, a lifter, at least one punch blade; (b) placing the metallic sheet on the die set; (c) adjusting a position of the metallic sheet for making a longitudinal center axis of the punch blade perpendicular to a plane tangential to a center of the predetermined punching areas; (d) applying the lifter to press down, and the punch blade punching one of the predetermined punching areas out of the metallic sheet; and (e) repeating steps (c) and (d) appropriately in turn to form a plurality of punched holes in the curved portion of the metallic sheet. The metallic workpiece made by the present method is also provided.

6 Claims, 4 Drawing Sheets

METALLIC WORKPIECE HAVING PUNCHED HOLES AND METHOD FOR MAKING THE SAME

BACKGROUND OF THE INVENTION

1. Field of the Invention

The present invention generally relates to metallic workpieces having a plurality of punched holes, and method for making the metallic workpiece.

2. Discussion of the Related Art

Typically, press punching method for making metallic workpiece has following advantages, such as, rapidly and accurately performing, and producing products free from defects. Accordingly, metallic workpieces from press punching method are widely used in car, electronic 3C, and home appliance fields.

A conventional method for making the metallic workpiece, having a curved portion and a number of punched holes defined in the curved portion, includes following steps: First, a flat metallic sheet is provided and placed on a punching machine. Second, the flat metallic sheet is punched to form many punched holes in the flat metallic sheet. Third, the metallic sheet is bent by a bending equipment for forming a curved portion therein. This forms the metallic workpiece. However, a number of the circular punched holes in the curved portion may be deformed into elliptical punched holes or other shapes due to the bending process. Therefore the sizes and shapes of the punched holes of the metallic workpiece may or may not retain its intended shape. This may results in unattractive workpieces.

What is needed, therefore, is a metallic workpiece having undesirable deformity of punched holes in a curved portion. Method for making the metallic workpiece is also desired.

SUMMARY

In one aspect, a metallic workpiece according to a preferred embodiment includes a curved portion with a plurality of punched holes defined in the curved portion. Each punched hole defines a center axis, and the center axis is perpendicular to a plane tangential to the curved portion at a point passed by the center axis.

In another aspect, a method for making the metallic workpiece described in previous paragraph, includes: (a) providing a metallic sheet and a punching machine, wherein the metallic sheet comprises a curved portion, and a plurality of predetermined punching areas defined on the curved portion for being punched; the punching machine comprises a die set, a lifter disposed above the die set, a punch blade disposed at a bottom end of the lifter; (b) placing the metallic sheet on the die set; (c) adjusting a position of the metallic sheet for making a longitudinal center axis of the at least one punch blade perpendicular to a plane tangential to a center of the predetermined punching areas; (d) applying the lifter to press downward, such that the punch blade punching one of the predetermined punching areas out of the metallic sheet; and (e) repeating steps (c) and (d) appropriately in turn to form a plurality of punched holes in the curved portion of the metallic sheet, whereby the metallic workpiece is formed.

Other advantages and novel features will become more apparent from the following detailed description of the preferred embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present metallic workpiece having a plurality of punched holes and method for making the same. Moreover, in the drawings, like reference numerals designate corresponding parts throughout the several views, and all the views are schematic.

DETAILED DESCRIPTION OF THE PREFERRED EMBODIMENTS

Reference will now be made to the drawings to describe, in detail, preferred embodiments of the present metallic workpiece having a plurality of punched holes and methods for making the metallic workpiece.

Figure 1:
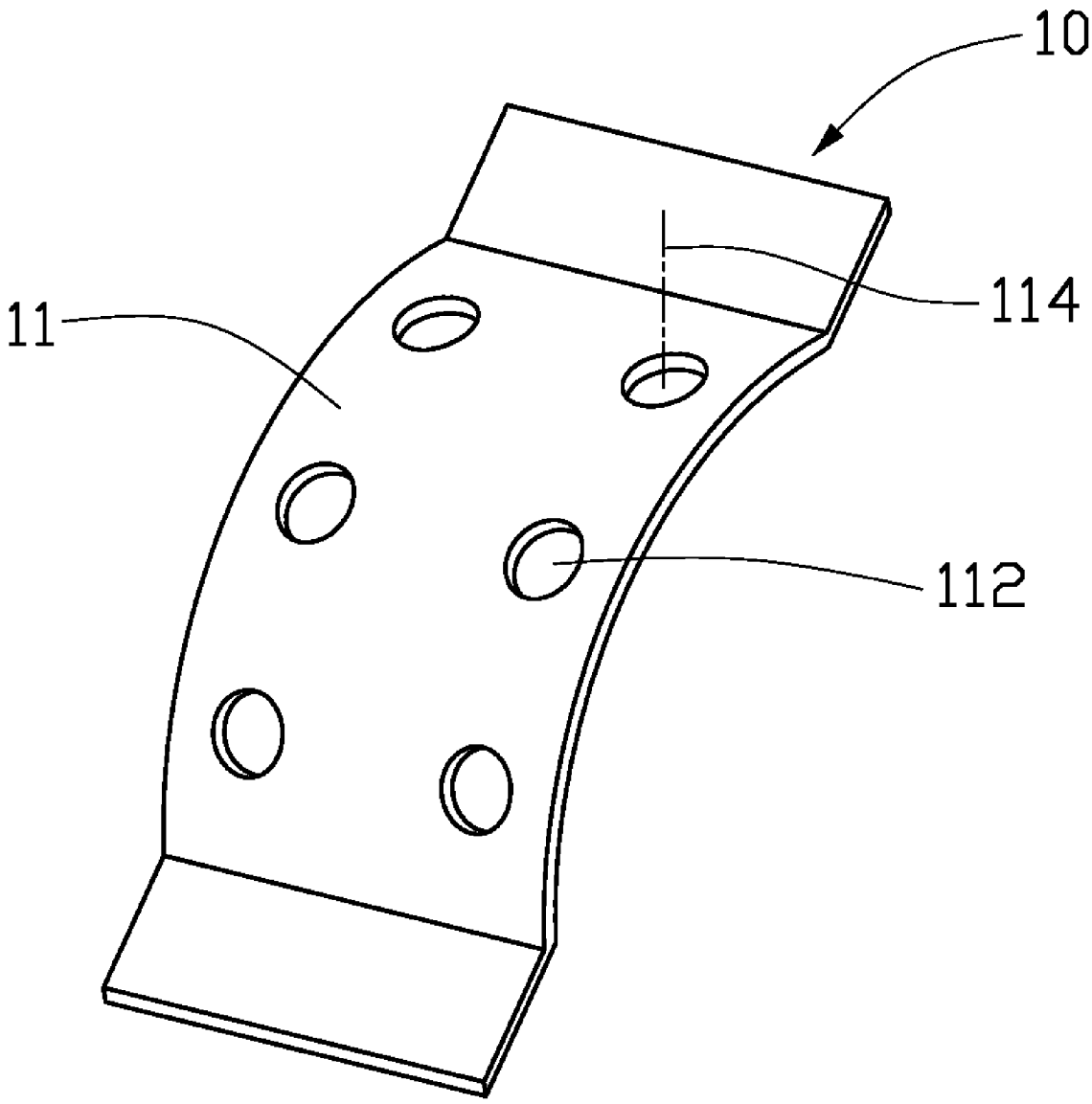
FIG. 1 is an isometric view of a metallic workpiece according to a preferred embodiment of the present invention.

Referring to FIG. 1, a metallic workpiece 10 manufactured by press punching method in accordance with a first preferred embodiment of the present invention is shown. The metallic workpiece 10 includes a curved portion 11, and a plurality of circular punched holes 112 defined in the curved portion 11. The curved portion 11 is arcuate in shape. The punched holes 112 are aligned in a matrix manner. Each circular punched hole 112 defines a center axis 114. The center axis 114 is perpendicular to a line tangent to the curved portion 11 at a point passed by the center axis 114.

Figure 2:
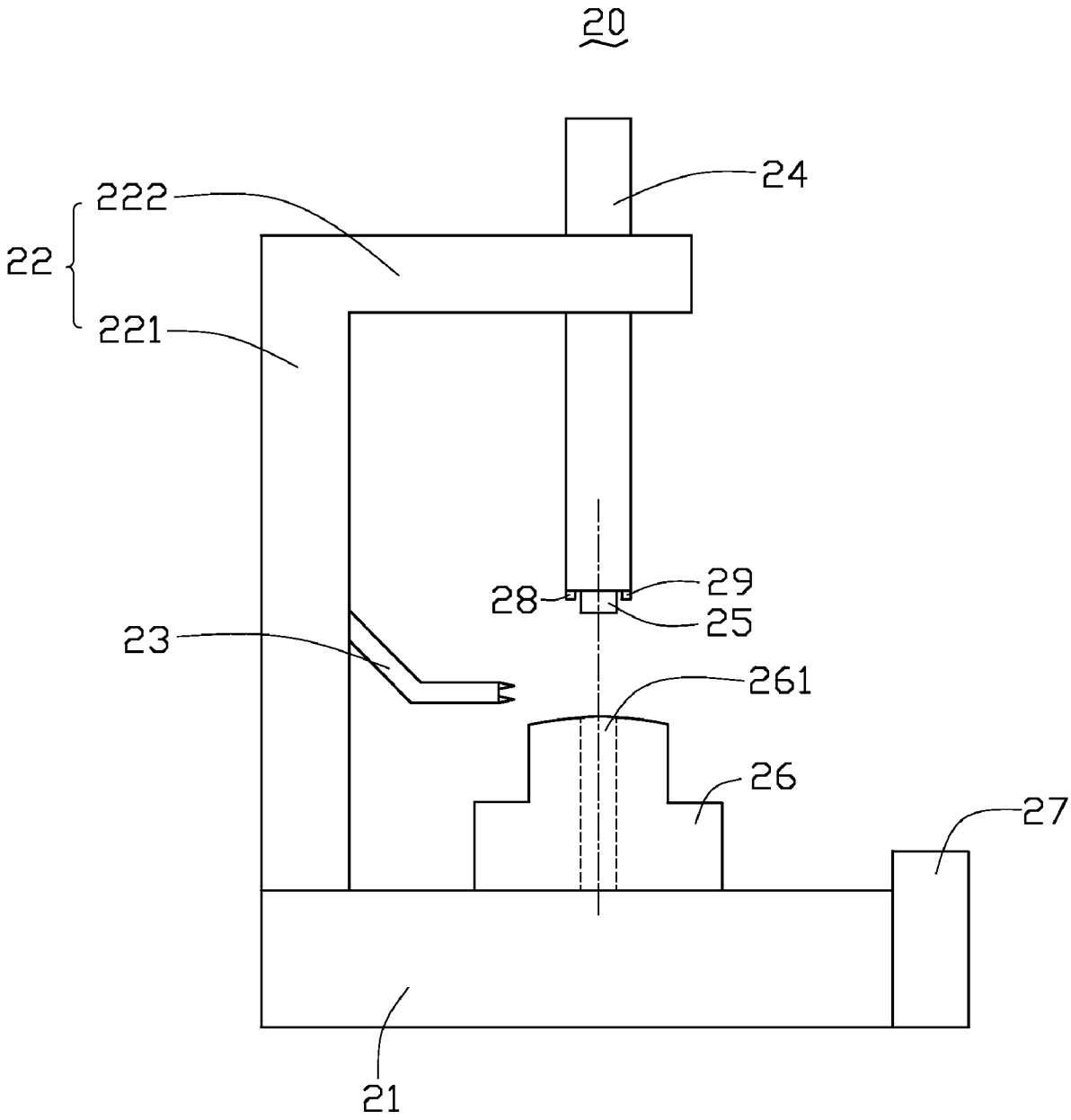
FIG. 2 is a side view of a punching machine for making the metallic workpiece of FIG. 1, the punching machine including a lifter, a punch blade, a laser emitter and a laser sensor.

Referring to FIG. 2, a punching machine 20 for making the metallic workpiece 10 is shown. The punching machine 20 includes a base 21, a supporting framework 22, a mechanical arm 23, a lifter 24, a punch blade 25, a die set 26, and a controller 27. The supporting framework 22 is attached to an end of the base 21. The supporting framework 22 includes a main frame 221 perpendicularly fixed to the base 21, and an extending frame 222 extending from the top of the main frame 221 and parallel to the base 21. The mechanical arm 23 is attached to the main frame 221. The die set 26 is disposed on a middle of the base 21.

The lifter 24 is fixed to the extending frame 222 above the die set 26, and can be movable relative to the extending frame 222. The punch blade 25 is positioned at a bottom end of the lifter 24. The die set 26 defines an aperture 261 corresponding to the punch blade 25. In the illustrated embodiment, the aperture 261 is a cylindrical hole, and the punch blade 25 is substantially a hollow cylinder in shape. When the punch blade 25 is pressed down, the punch blade 25 can enter into the aperture 261. The controller 27 is positioned on another end of the base 21 opposite to the supporting framework 22 for controlling the mechanical arm 23 and the lifter 24 correspondingly.

Figure 3:
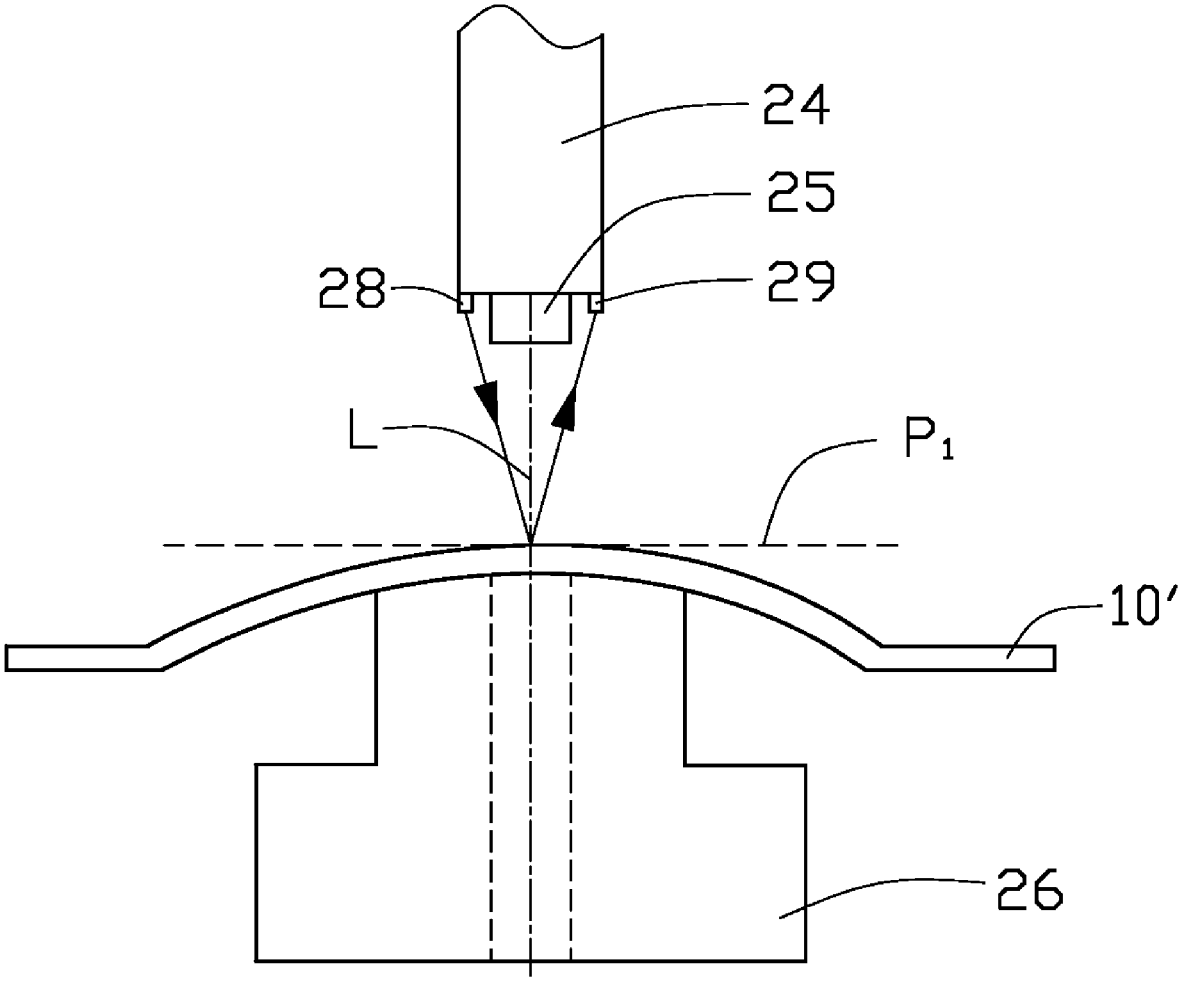
FIG. 3 is a side view of the punching machine of FIG. 2, showing a light path from the laser emitter to the laser sensor.
Figure 4:
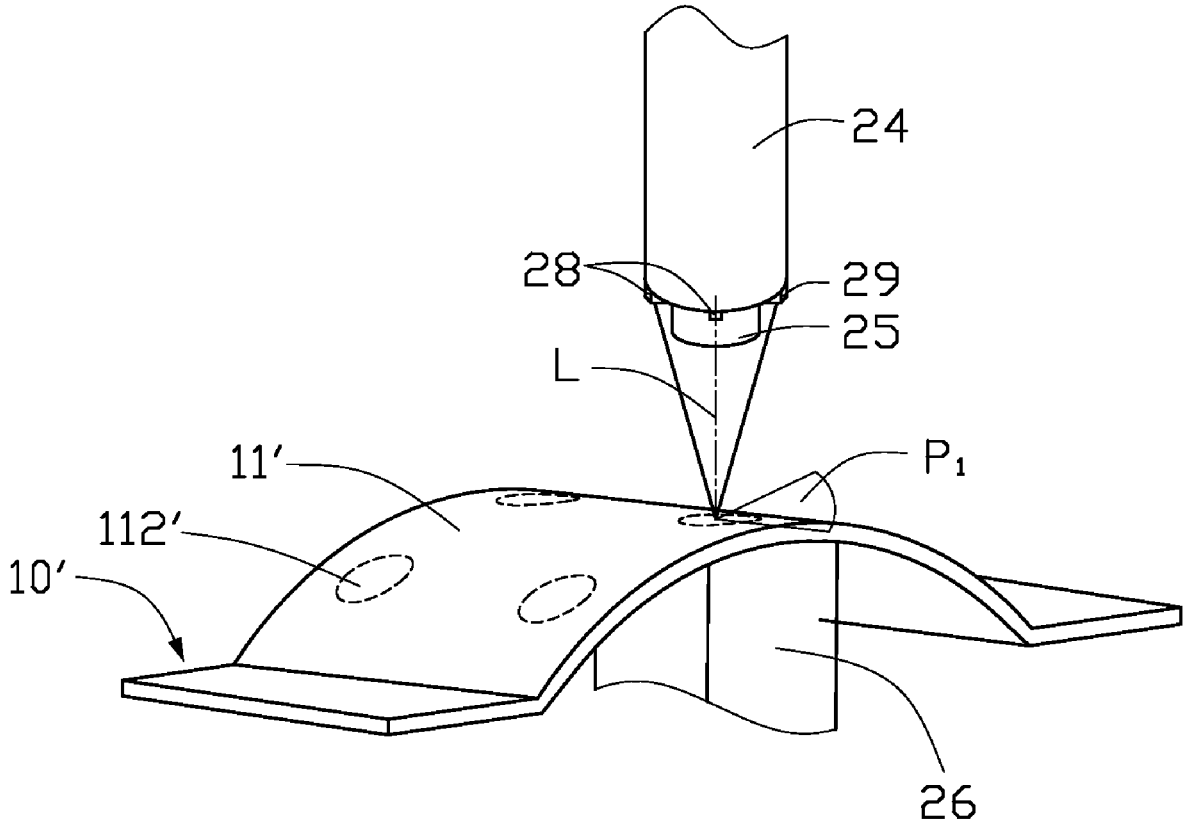
FIG. 4 is a partial, isometric view of the punching machine of FIG. 2, showing a longitudinal center axis of the punch blade perpendicular to a tangent plane of one of predetermined punching areas of a metallic sheet.

Referring to FIGS. 3 and 4, the punch blade 25 defines a longitudinal center axis L. At least an emitter-sensor pair consisting of a laser emitter 28 and a laser sensor 29 is disposed on the bottom end of the lifter 24 on opposite sides of the punch blade 25. The laser emitter 28 and the laser sensor 29 are disposed symmetrically relative to the longitudinal center axis L of the punch blade 25. In the illustrated embodiment, the punching machine 20 includes two emitter-sensor pairs.

In production, a metallic sheet 10' is provided. The metallic sheet 10' includes a curved portion 11', and a plurality of predetermined punching areas 112' defined on the curved portion 11'. The predetermined punching areas 112' are to be punched out (removed) from the metallic sheet 10' thereby yielding the metallic workpiece 10. The controller 27 controls the mechanical arm 23 to grasp the metallic sheet 10' and place the metallic sheet 10' on the die set 26 such that the curved portion 112' of the metallic sheet 10' is in full contact with the top surface of the die set 26. One of the predetermined punching areas 112' approximately corresponds to the punch blade 25. The laser emitter 28 is applied to emit a laser light towards one of the predetermined punching areas 112'. If the laser sensor 29 cannot receive the laser light, a position of the mechanical arm 23 is adjusted very precisely to fine tune a position of the predetermined punching area 112' of the metallic sheet 10' until the laser sensor 29 receives the laser light reflected by the metallic sheet 10'. It is to be understood that, only a longitudinal center axis of the punch blade 25 is being adjusted to be perpendicular to a tangent plane $P_1$ defined by the predetermined punching area 112' because this will make the laser sensor 29 receive the laser light completely. When the laser sensor 29 receives the laser light, the laser sensor 29 will send a turn-on signal to the controller 27. Afterwards, when the controller 27 receives the turn-on signal, the lifter 24 is signaled by the controller 27 to press downwards, thus, the punch blade 25 punches the predetermined punching area 112' out of the metallic sheet 10'.

After one of the punching areas of the metallic sheet 10' has been punched, the punch blade 25 and the lifter 24 retracts to their original positions. The same procedures as described above are repeated until all of the punching areas are punched out, thereby yielding the metallic workpiece 10.

Because the tangent plane of a center of the predetermined punching area (punched hole) of the present metallic workpiece is adjusted to be perpendicular to a longitudinal center axis of the punch blade 25 before the punching step, the metallic workpiece may have uniform and well defined punched holes. When compared with the metallic workpiece made by conventional punching method, the present metallic workpiece has a more attractive appearance.

It is to be understood that, the present method can manufacture a metallic workpiece having a plurality of curved portions and a number of punched holes defined in the curved portions respectively. It should be pointed out that, the punch machine 20 can include an array of punch blades 25 positioned on the distal end of the lifter 24, and many pairs of the laser emitter 28 and the laser sensor 29 disposed symmetrical to each punch blade 25. The die set 26 defines a plurality of apertures 261 corresponding to the punch blade 25.

Finally, while the present invention has been described with reference to particular embodiments, the description is illustrative of the invention and is not to be construed as limiting the invention. Therefore, various modifications can be made to the embodiments by those skilled in the art without departing from the true spirit and scope of the invention as defined by the appended claims.

What is claimed is:

1. A method for making a metallic workpiece, comprising:

(a) providing a metallic sheet and a punching machine, wherein the metallic sheet comprises a curved portion, and a plurality of predetermined punching areas defined on the curved portion for being punched; the punching machine comprises a die set, a lifter disposed above the die set, a punch blade disposed at a bottom end of the lifter, a controller, a mechanical arm, and at least an emitter-sensor pair consisting of a laser emitter and a laser sensor disposed on a bottom end of the lifter on opposite sides of the punch blade, the laser emitter and the laser sensor disposed symmetrically relative to a longitudinal center axis of the punch blade, the mechanical arm and the lifter being controlled by the controller;

(b) placing the metallic sheet on the die set;

(c) determining whether a longitudinal center axis of the punch blade is perpendicular to a plane tangential to a center of the predetermined punching areas and adjusting a position of the metallic sheet for making the longitudinal center axis of the punch blade perpendicular to the plane tangential to the center of the predetermined punching areas;

(d) applying the lifter to press downward, such that the punch blade punching one of the predetermined punching areas out of the metallic sheet; and (e) repeating steps (c) and (d) appropriately in turn to form a plurality of punched holes in the curved portion of the metallic sheet, whereby the metallic workpiece is formed.

2. The method for making a metallic workpiece as claimed in claim 1, wherein the mechanical arm can adjust a position of the metallic sheet on the die set.

3. The method for making a metallic workpiece as claimed in claim 1, wherein the laser emitter is applied to emit a laser light towards one of the predetermined punching areas; if the laser sensor cannot receive the reflected laser light, a position of the mechanical arm is adjusted very precisely to micromove the metallic sheet until the laser sensor receives the laser light reflected by the metallic sheet.

4. The method for making a metallic workpiece as claimed in claim 1, wherein the punching machine further comprises a base and a supporting framework; the supporting framework is disposed on an end of the base; the supporting framework comprises a main frame perpendicularly fixed to the base, and an extending frame extending from the top of the main frame and perpendicularly towards a center of the base; the mechanical arm is attached to the main frame; and the lifter is movably fixed to the extending frame above the die set.

5. The method for making a metallic workpiece as claimed in claim 1, wherein the die set defines an aperture corresponding to the punch blade, and the punch blade matching with the aperture.

6. The method for making a metallic workpiece as claimed in claim 5, wherein the aperture is a cylindrical hole, the punch blade is a hollow cylinder, and the punch blade can enter the aperture.

* * * * *